US007866843B2

(12) United States Patent
Senkyr

(10) Patent No.: US 7,866,843 B2
(45) **Date of Patent: *Jan. 11, 2011**

(54) CORNER MOUNTED LIGHT FIXTURE

(75) Inventor: Keith A. Senkyr, Elkton, KY (US)

(73) Assignee: RLR Industries, Mableton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/694,054

(22) Filed: Jan. 26, 2010

(65) Prior Publication Data

US 2010/0128469 A1 May 27, 2010

Related U.S. Application Data

(63) Continuation of application No. 12/121,046, filed on May 15, 2008, now Pat. No. 7,726,834.

(51) Int. Cl.
*F21S 4/00* (2006.01)

(52) U.S. Cl. ..... 362/223; 362/217.12; 362/217.14; 362/217.16

(58) Field of Classification Search ..... 362/145, 362/147, 362, 368, 370, 223, 217.12, 217.13, 362/217.14, 217.15, 217.16
See application file for complete search history.

(56) References Cited

U.S. PATENT DOCUMENTS

| | | | | |
|---|---|---|---|---|
| 2,428,827 | A | 10/1947 | Beck | |
| 2,694,137 | A | 11/1954 | Williams | |
| 3,311,744 | A | 3/1967 | Weeks | |
| 4,246,629 | A | 1/1981 | Marrero | |
| 4,338,653 | A | 7/1982 | Marrero | |
| 4,352,151 | A | 9/1982 | Lewis | |
| 4,862,333 | A | 8/1989 | Brasket | |
| 4,894,758 | A | 1/1990 | O'Toole | |
| 5,057,980 | A | 10/1991 | Russell | |
| D330,268 | S | 10/1992 | Jaksich | |
| 5,297,011 | A | 3/1994 | Triunfol | |
| 5,349,134 | A | 9/1994 | Russell | |
| 5,363,295 | A | 11/1994 | DeKleine et al. | |
| 5,720,548 | A | 2/1998 | Geary | |
| D393,734 | S | 4/1998 | Casteel | |
| D398,413 | S | 9/1998 | Compton | |
| D405,908 | S | 2/1999 | Herst et al. | |
| D491,687 | S | 6/2004 | Thornton, Jr. et al. | |
| D497,217 | S | 10/2004 | Thornton, Jr. et al. | |
| 7,055,992 | B1 | 6/2006 | Accornero | |
| 7,226,027 | B1 | 6/2007 | Feeley | |
| 7,726,834 | B2 * | 6/2010 | Senkyr | 362/223 |

* cited by examiner

*Primary Examiner*—John A Ward
(74) *Attorney, Agent, or Firm*—Gardner Groff Greenwald & Villanueva, PC

(57) ABSTRACT

A corner mounted lighting fixture having alignment features on its fixture base and on its diffuser for maintaining alignment with the corner during assembly and installation. The diffuser is positioned at an incline within the corner for improved light distribution. Attachment is along the axis of the corner for ease of installation.

20 Claims, 4 Drawing Sheets

CORNER MOUNTED LIGHT FIXTURE

CROSS-REFERENCE TO RELATED APPLICATION

This application is a continuation of U.S. Non-Provisional patent application Ser. No. 12/121,046 filed May 15, 2008, the entirety of which is hereby incorporated herein by reference for all purposes.

TECHNICAL FIELD

The present invention relates generally to the field of lighting, and more particularly to light fixtures.

BACKGROUND OF THE INVENTION

Many varieties of lighting fixtures are known, including ceiling mounted fixtures, wall mounted fixtures, floor standing lamps, table lamps, and the like. In some instances, users may wish to mount a lighting fixture in a corner between two walls. Corner mounted applications commonly require more precise alignment during installation than typical wall mounted light fixture applications. This is especially so in applications where the fixture and/or associated diffuser components are intended to closely align with the walls adjacent the corner, in fixtures that are installed at compound angles, and/or in fixtures that provide directed light distribution. Inaccurate alignment during installation can result in an uneven or incorrect light distribution, present a shoddy appearance, and in some instances may interfere with proper structural support and anchoring of the fixture onto the wall.

In order to provide proper alignment in corner mounted applications, previously known corner light fixtures have often required the provision of a specially configured housing and/or attachment base apparatus for containing associated wiring, switches, electronics, lamp sockets, etc. As a result, economies of scale available for higher volume standard fixture arrangements are generally unobtainable. Alternatively, specialized tools or mounting hardware may be required, which can also increase costs substantially. Many consumers prefer a fixture that they can install themselves, without the need for hiring an electrician or other professional to install.

Accordingly, it can be seen that needs exist for an improved corner mounted lighting fixture. It is to the provision of an improved corner mounted lighting fixture meeting these and other needs that the present invention is primarily directed.

SUMMARY OF THE INVENTION

The present invention provides an improved corner mounted lighting fixture. In example embodiments, the corner mounted lighting fixture of the present invention is economical and easy to install in a typical room corner, and provides proper alignment and light distribution without the need for specialized tools, training, or separate hardware.

In one aspect, the present invention is a light fixture for mounting in an inside corner between first and second walls, the intersection of the first and second walls defining a corner axis and an included corner angle therebetween. The light fixture preferably includes a fixture base having at least one receiver for an electric lamp, and preferably further includes at least one corner bracket extending from the fixture base. Each corner bracket preferably defines a distal included angle substantially equal to the included corner angle between the first and second walls. The fixture preferably also includes a diffuser removably attachable to the fixture base, and having a first side extending proximal the first wall and a second side extending proximal the second wall.

In another aspect, the invention is a light fixture including an enclosed strip fixture that is a generally box-shaped enclosure formed by a back panel, first and second side panels, a top panel and a bottom panel, a front cover plate, and at least one pair of receivers for engaging a linear fluorescent lamp. The light fixture preferably also includes a diffuser having a front panel, an upper mounting flange and a lower mounting flange. The upper mounting flange attaches to the top panel of the enclosed strip fixture, and the lower mounting flange attaches to the bottom panel of the enclosed strip fixture. In this manner, the upper mounting flange defines a first distance between the front panel and the enclosed strip fixture, and the lower mounting flange defines a second distance between the front panel and the enclosed strip fixture, the first and second distances being unequal whereby the front panel of the diffuser is angularly inclined relative to the enclosed strip fixture In still another aspect, the invention is a method of installing a light fixture in a corner between first and second walls, a line of intersection of the first and second walls defining a corner axis. The method preferably includes mounting a fixture base along the corner axis by aligning at least one angular alignment flange extending from the fixture base within the corner, and installing at least one fastener through the fixture base and intersecting the corner axis. The method preferably also includes affixing a diffuser to the fixture base by aligning at least one surface of a mounting flange portion of the diffuser with at least one of the first and second walls and securing at least one fastener between the diffuser and the fixture base These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
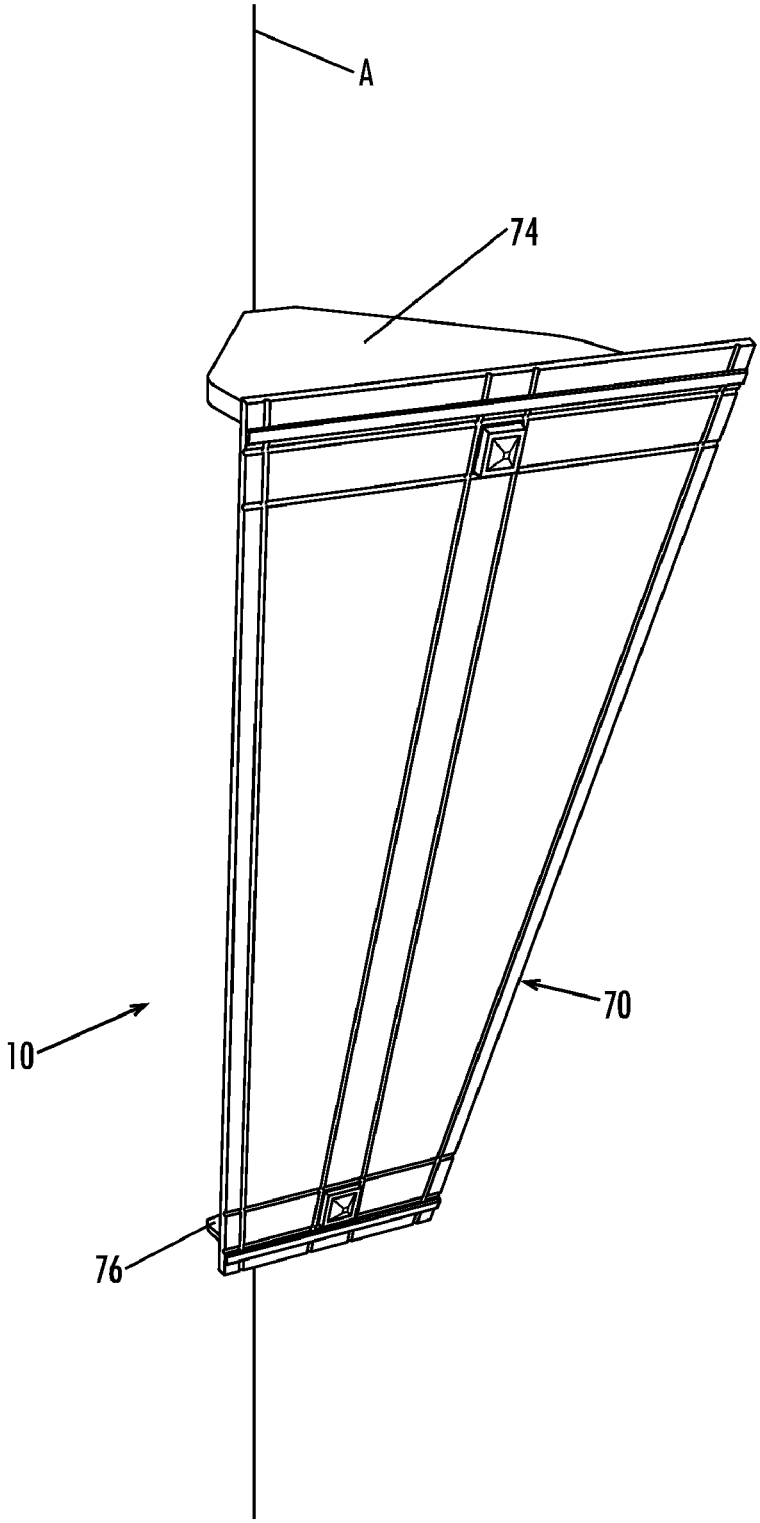
FIG. 1 is a front perspective view of a corner mounted light fixture according to an example embodiment of the present invention.
Figure 2:
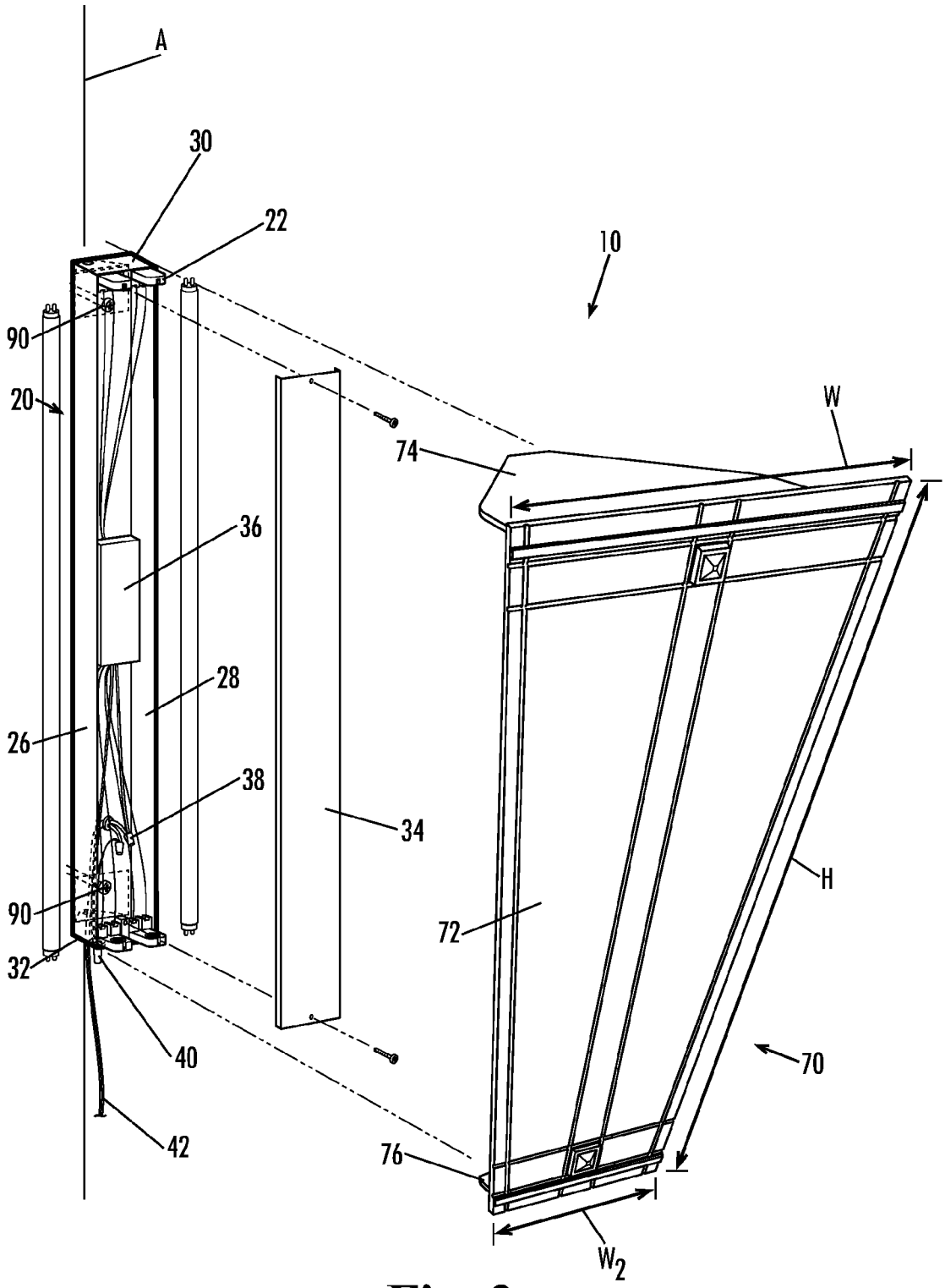
FIG. 2 is an assembly view of the corner mounted light fixture of FIG. 1.

With reference now to the drawing figures, wherein like reference numbers represent corresponding parts throughout the several views, FIGS. 1-4 show a light fixture 10 according to an example form of the present invention. FIGS. 1 and 2 show the light fixture 10 mounted at an inside corner having a corner axis A formed at the intersection of two walls of a building. Typically the corner will be a right angle corner defining an included corner angle of about 90°, but in alternate embodiments the fixture of the present invention may be adapted to other corner configurations as well. In 90° corner installations, the front panel of the fixture 10 preferably extends at about a 45° angle from each wall, and the side edges of the front panel are in close alignment along substantially their entire length with the walls on either side of the corner and approximately equidistant from the corner on opposed sides thereof. The spacing between each side of the front panel of the fixture and the adjacent wall is preferably substantially constant along substantially the entire length of both sides.

In the example embodiment depicted in the drawing figures, the lighting fixture 10 comprises a fixture base 20 and a diffuser or lens assembly 70 that is removably attachable to the fixture base. The fixture base 20 preferably includes one or more sockets or clips 22 for receiving lamps or other light sources. In the depicted embodiment, the fixture base 20 is an enclosed strip fixture for receiving two linear fluorescent lamps (such as for example T-5 or T-8 fluorescent light tubes) having two pairs of front mounted lamp attachment clips. In alternate embodiments, the fixture base 20 is configured for use with one or more other linear fluorescent lamp types, compact fluorescent lamp(s) (CFLs), incandescent lamp(s), LED lamp(s), and/or other forms of light sources; and may have front-mounted, side-mounted or otherwise configured attachment clips or sockets for receiving the light source(s).

The fixture base 20 of the depicted embodiment comprises a generally rectangular box having a back panel 24, first and second side panels 26, 28, a top panel 30 and a bottom panel 32, and a removable front cover plate 34 securable to the box by one or more screws, clips or other fasteners. The fixture base 20 includes a fluorescent lighting ballast 36, wiring 38, and a switch 40 for turning the light on and off. In alternate embodiments, the fixture base may contain various other associated electronics for controlling and operating the light sources. In the depicted embodiment, the switch 40 is a push-button switch, but in alternate embodiments can comprise a rocker switch, a toggle switch, a pull-chain switch, a motion sensor, or other form of electronic switch or actuator. A power cord 42 optionally extends from the fixture base 20 and can include a standard two-prong or 3-prong plug for connection to a nearby electric receptacle. In alternate forms, the fixture comprises connection clips or terminals for hard-wired connection to an A/C electric box or can be powered by one or more onboard or external batteries, a photovoltaic cell, or other energy source.

One or more corner brackets 50 extend from the back panel 24 of the fixture base 20, to provide alignment of the fixture 10 in a corner between two walls. In the example embodiment depicted in the figures, two corner brackets are present: an upper corner bracket 50*a* proximal the top 30, and a lower corner bracket 50*b* proximal the bottom 32. The corner brackets 50 include an attachment flange portion 52 affixed to the back panel 24 of the fixture base 20, and an alignment flange portion 54 extending generally perpendicularly from the back panel. In the depicted embodiment, the corner brackets 50 are separately formed sheet-metal components affixed to the fixture base 20 by one or more screws or other fasteners, but in alternate embodiments the corner brackets can comprise integrally formed extensions of the fixture base. The alignment flange portion 54 of each corner bracket 50 is preferably generally triangular in profile; most preferably in the form of an isosceles right triangle with its apex distal the attachment flange and defining an included angle of 90°, and with its vertices proximal the attachment flange and adjacent the first and second side panels 26, 28 and defining included angles of 45° each. Optionally, the distal apex 56 of the alignment flange portion 54 is radiused to remove the sharp corner, for safety and to provide clearance for installation. A cord opening 58 is optionally provided through the alignment flange portion 54 to permit the power cord 42 to extend therethrough, preferably with a grommet or bushing installed therebetween to prevent cutting the insulation of the cord. In the depicted embodiment, the upper and lower corner brackets 50*a*, 50*b* are substantially identical in size and configuration, such that the fixture base is oriented generally parallel to the axis of the corner in which the fixture is installed. In alternate forms, the upper and lower corner brackets may differ to provide different orientations upon installation, for example by providing a larger upper corner bracket and a smaller lower corner bracket to orient the fixture base with its front facing downwardly at an oblique angle relative to the axis of the corner when installed.

The diffuser or lens assembly 70 is preferably formed of a transparent or translucent material such as plastic, Plexiglas, glass or the like. The material of the diffuser or lens assembly 70 is optionally frosted, etched or otherwise treated, or may have a surface coating or laminate sheet applied thereon, for aesthetics and/or to provide more even or controlled light distribution. One or more patterns and/or surface features are optionally also included thereon for ornamentation and/or source designation purposes. In the depicted example, the diffuser or lens 70 has a generally trapezoidal front panel 72, and upper and lower mounting flanges 74, 76 projecting outwardly from the rear face of the front panel. More particularly described, the front panel 72 of the depicted embodiment is a flat panel having an outer peripheral profile defining an isosceles trapezoid, symmetric about a vertical medial axis, and having a height H, an upper width $W_1$, and a lower width $W_2$, and in the general proportions of: $H \geqq W_1 \geqq W_2$. In alternate forms, the front panel 72 can be triangular, rectangular or of other shape and/or proportions.

Figure 3:
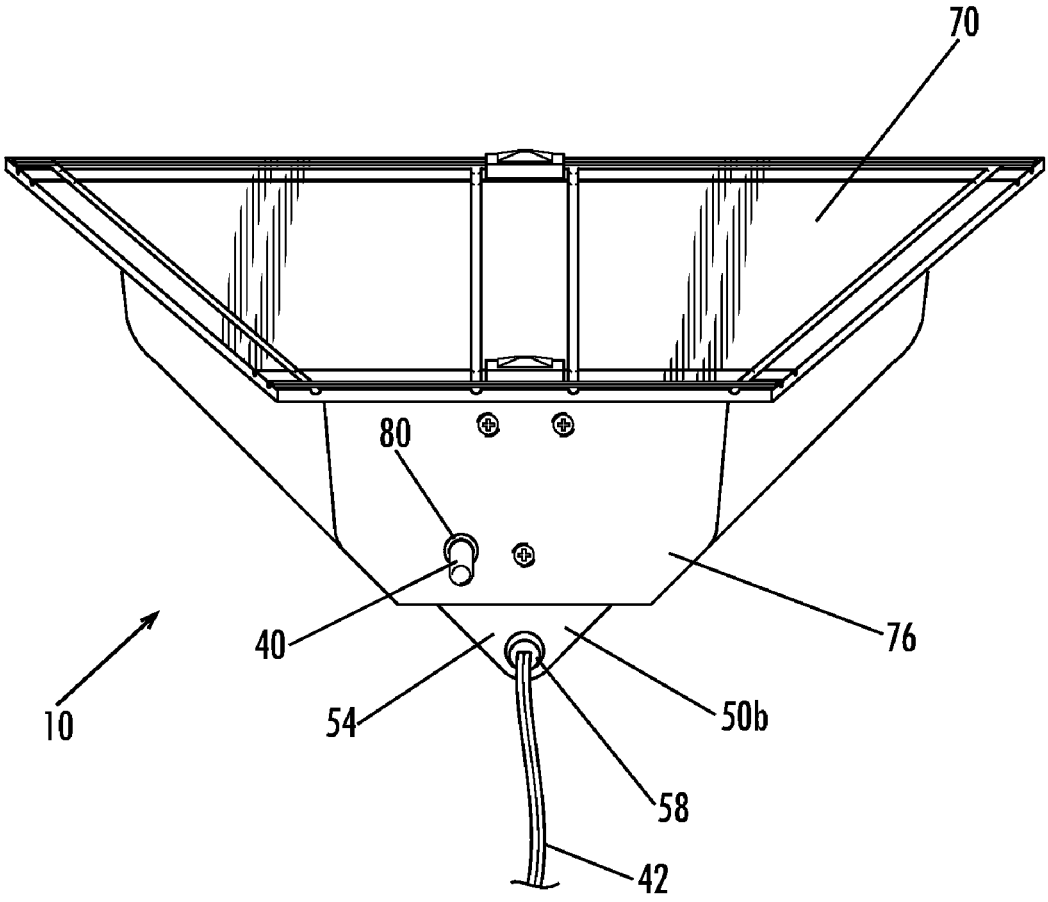
FIG. 3 is a bottom view of the corner mounted light fixture of FIG. 1.
Figure 4:
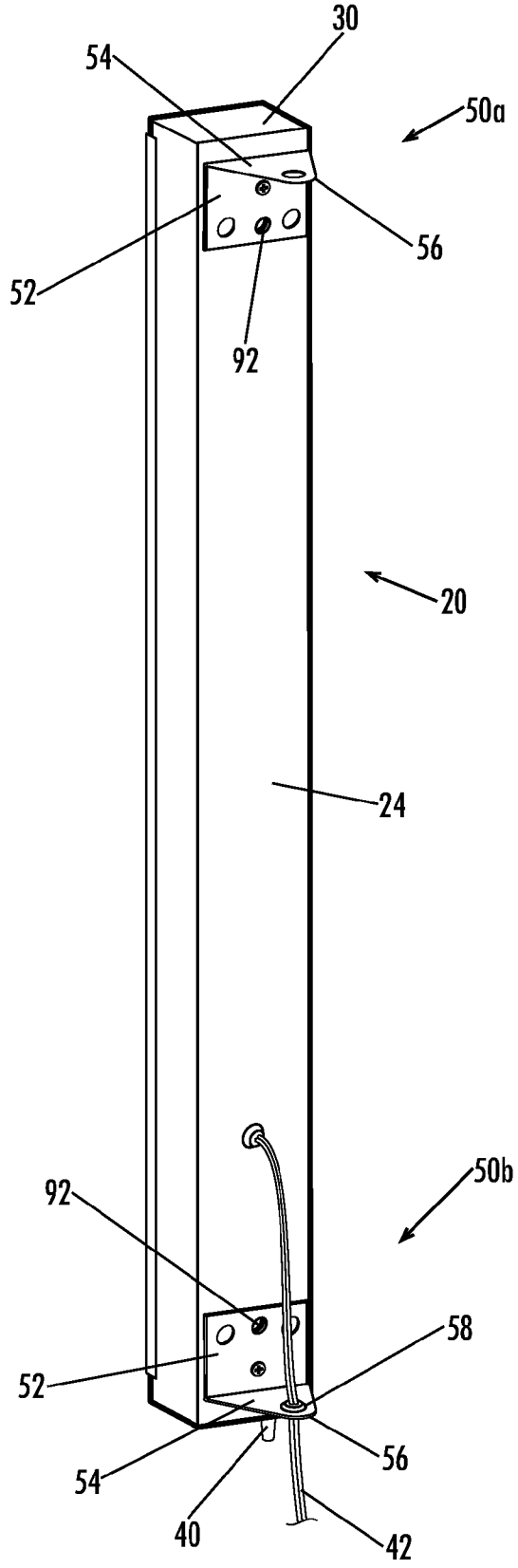
FIG. 4 is a back perspective view of part of the corner mounted light fixture of FIG. 1.

The upper and lower mounting flanges 74, 76 can comprise separate components attached to the front panel 72, as for example by angle brackets and screws or other fasteners, and/or can comprise integral portions of a unitary molding including one or both mounting flanges and the front panel. Each of the upper and lower mounting flanges 74, 76 comprise 45° chamfers at distal side edges thereof, whereby the flanges fit within a 90° corner and assist, in combination with the alignment flanges 54, in maintaining proper alignment of the fixture 10 when mounted to a wall corner. When installed, an open space preferably remains between the rear edge of the mounting flanges and the corner axis, to allow for cord passage as shown in FIG. 3. In the depicted embodiment, the upper mounting flange 74 is substantially larger than the lower mounting flange 76, such that the top of the front panel 72 is spaced further away from the corner axis A than the bottom of the front panel when the fixture 10 is installed and assembled, whereby the lens 70 is obliquely oriented at a mounting angle of between about 5° to about 30°, to distribute light generally downwardly and outwardly from the corner. In alternate forms, the arrangement can be reversed such that the bottom of the front panel is further from the corner axis than the top, to distribute light obliquely upwardly; or the upper and lower mounting flanges 74, 76 can be substantially equal in size to orient the lens 70 generally parallel to the corner axis to distribute light outwardly. One or both of the upper and/or lower mounting flanges 74, 76 preferably include a switch opening 80 in the form of a hole or slot for access or passage of the switch or other actuator 40 for turning the light on and off.

The fixture 10 is mounted in a corner by removing the cover plate 34 of the fixture base 20, and installing one or more screws 90 or other fasteners (two screws are used in the depicted example) through holes 92 through the back panel 24 and/or through the corner brackets 50, and into the supporting structure at or in the immediate vicinity of the corner axis A, as shown in FIG. 2. Preferably, fasteners installed at the corner axis are the only attachment means necessary to secure the fixture to the wall corner, thus simplifying installation. Typically, wall studs or other framing members are present at a wall corner, providing a readily located solid attachment mechanism. In alternate forms of the invention, one or more mounting tabs or brackets extend from the fixture base for attachment into the wall corner without the need for removal of the cover plate. The corner brackets 50 serve as self-alignment positioners during installation, as well as structural mounting braces after installation. The cover plate 34 is then replaced and reattached to the fixture base. The lamps, bulbs or light tubes are installed if not already in place, in typical fashion. The diffuser 70 is installed by attaching one or both of the upper and lower mounting flanges 74, 76 to the fixture base 20 by one or more screws, snap fittings, lamp finials, push-pin connectors or other fasteners. The angled chamfers allow the mounting flanges to serve as alignment guides during installation, as well as support brackets when installed. The power cord can then be plugged in and the switch actuated to operate the light in typical fashion.

While the invention has been described with reference to preferred and example embodiments, it will be understood by those skilled in the art that a variety of modifications, additions and deletions are within the scope of the invention, as defined by the following claims.

What is claimed is:

1. A light fixture for mounting in an inside corner between first and second walls, the intersection of the first and second walls defining a corner axis and an included corner angle therebetween, said light fixture comprising:

a fixture base comprising at least one receiver for an electric lamp, said fixture base further comprising at least one corner bracket extending therefrom, each said corner bracket having a distal included angle substantially equal to the included corner angle between the first and second walls; and a diffuser removably attachable to the fixture base, said diffuser comprising a first side extending proximal the first wall, a second side extending proximal the second wall, and upper and lower mounting flanges for attachment to the fixture base, wherein the upper mounting flange positions a top portion of the diffuser at a first distance from the corner axis, and the lower mounting flange positions a bottom portion of the diffuser at a second distance from the corner axis.

2. The light fixture of claim 1, wherein the diffuser is symmetrical about a vertical medial axis.

3. The light fixture of claim 1, wherein the upper mounting flange of the diffuser is substantially larger than the lower mounting flange of the diffuser.

4. The light fixture of claim 1, wherein the diffuser is trapezoidal, triangular, or rectangular shaped.

5. The light fixture of claim 1, wherein the upper and lower mounting flanges comprise 45° chamfers on side edges thereof.

6. The light fixture of claim 1, wherein one of the upper and lower mounting flanges defines an access opening for passage of a power switch of the fixture base therethrough.

7. The light fixture of claim 1, wherein a front panel portion of the diffuser is positioned at an oblique angle relative to the corner axis when the fixture is mounted in the corner.

8. The light fixture of claim 1, wherein an open space remains between a rear edge of the mounting flanges and the corner axis when the fixture is mounted in the corner, thereby allowing for passage of a power cord therethrough.

9. The light fixture of claim 1, wherein the diffuser comprises a front panel having a profile defining a trapezoid with a height H, an upper width $W_1$, and a lower width $W_2$, and wherein $H \geqq W_1 \geqq W_2$.

10. A light fixture for mounting in an inside corner between first and second walls, the intersection of the first and second walls defining a corner axis and an included corner angle therebetween, said light fixture comprising:

a fixture base comprising at least one receiver for an electric lamp, said fixture base further comprising at least one corner bracket extending therefrom, each said corner bracket having a distal included angle substantially equal to the included corner angle between the first and second walls; and a diffuser removably attachable to the fixture base, said diffuser comprising a first side extending proximal the first wall, a second side extending proximal the second wall, and a front panel having a profile defining a trapezoid having a height H, an upper width $W_1$, and a lower width $W_2$, wherein $H \geqq W_1 W_2$.

11. The light fixture of claim 10, wherein the diffuser is symmetrical about a vertical medial axis.

12. The light fixture of claim 10, wherein the upper mounting flange of the diffuser is substantially larger than the lower mounting flange of the diffuser.

13. The light fixture of claim 10, wherein the diffuser is trapezoidal, triangular, or rectangular shaped.

14. The light fixture of claim 10, wherein the upper and lower mounting flanges comprise 45° chamfers along sides thereof.

15. The light fixture of claim 10, wherein one of the upper and lower mounting flanges defines an access opening for passage of a power switch of the fixture base therethrough.

16. The light fixture of claim 10, wherein a front panel portion of the diffuser is positioned at an oblique angle relative to the corner axis when the fixture is mounted in the corner.

17. The light fixture of claim 10, wherein an open space remains between a rear edge of the mounting flanges and the corner axis when the fixture is mounted in the corner, thereby allowing for passage of a power cord therethrough.

18. A light fixture for mounting in an inside corner between first and second walls, the intersection of the first and second walls defining a corner axis and an included corner angle therebetween, said light fixture comprising:

a fixture base comprising at least one receiver for an electric lamp, said fixture base further comprising at least one corner bracket extending therefrom, each said corner bracket having a distal included angle substantially equal to the included corner angle between the first and second walls;

a diffuser removably attachable to the fixture base, said diffuser comprising a first side extending proximal the first wall, a second side extending proximal the second wall, upper and lower mounting flanges for attachment to the fixture base, and a front panel having a profile defining a trapezoid having a height H, an upper width $W_1$, and a lower width $W_2$, wherein $H \geqq W_1 \geqq W_2$; and wherein the upper mounting flange positions a top portion of the diffuser at a first distance from the corner axis, and the lower mounting flange positions a bottom portion of the diffuser at a second distance from the corner axis, said first distance being greater than said second distance.

19. The light fixture of claim 18, wherein the upper and lower mounting flanges comprise 45° chamfers along sides thereof.

20. The light fixture of claim 18, wherein a front panel portion of the diffuser is positioned at an oblique angle relative to the corner axis when the fixture is mounted in the corner.

* * * * *